US006648557B1

(12) United States Patent
Morrow et al.

(10) Patent No.: US 6,648,557 B1
(45) Date of Patent: Nov. 18, 2003

(54) DRILLING APPARATUS AND METHOD FOR SINGLE PASS BOLTING

(75) Inventors: Robert J. Morrow, Manning (AU); Alexander Donald Patience, Kambalda (AU)

(73) Assignee: Raers Corporation Pty Ltd., Western Australia (AU)

( * ) Notice: Subject to any disclaimer, the term of this patent is extended or adjusted under 35 U.S.C. 154(b) by 0 days.

(21) Appl. No.: 10/018,438

(22) PCT Filed: Apr. 27, 2000

(86) PCT No.: PCT/AU00/00380

§ 371 (c)(1),
(2), (4) Date: Oct. 30, 2001

(87) PCT Pub. No.: WO00/66873

PCT Pub. Date: Nov. 9, 2000

(30) Foreign Application Priority Data

Apr. 30, 1999 (AU) ..... PQ0097

(51) Int. Cl.[7] ..... E21D 20/00; E21D 21/00

(52) U.S. Cl. ..... 405/259.1; 405/288; 405/302.1; 411/30; 411/31

(58) Field of Search ..... 405/259.1, 288, 405/302.1; 52/698, 701; 411/29, 30, 31, 387.8, 387.6, 387.5, 387.3, 440, 441

(56) References Cited

U.S. PATENT DOCUMENTS 3,851,560 A * 12/1974 Yago ..... 411/30
4,026,186 A * 5/1977 Williams et al. ..... 411/29
4,617,692 A * 10/1986 Bond et al. ..... 7/158
4,711,309 A * 12/1987 Knight et al. ..... 175/93
5,067,854 A * 11/1991 Sweeney ..... 405/184
5,246,323 A * 9/1993 Vernet et al. ..... 411/29
5,374,140 A * 12/1994 Standish et al. ..... 405/259.5
5,433,558 A * 7/1995 Gray ..... 405/259.1
5,649,789 A * 7/1997 Denz ..... 405/259.1
5,741,099 A * 4/1998 Aasgaard ..... 411/29
5,820,321 A * 10/1998 Gruber ..... 411/36
6,309,159 B1 * 10/2001 Weaver et al. ..... 411/387.5

FOREIGN PATENT DOCUMENTS

CA 2206909 A 12/1998

* cited by examiner

*Primary Examiner*—J. J. Swann
*Assistant Examiner*—Katherine Mitchell
(74) *Attorney, Agent, or Firm*—Reising, Ethington, Barnes, Kisselle, P.C.

(57) ABSTRACT

A drilling apparatus for single pass bolting, the drilling apparatus comprising a drill steel assembly and a disposable drill bit, wherein the drill steel assembly comprises at least a drill steel having first and second ends, the first end of the drill steel being adapted to releasably operatively engage a drive for imparting rotational and impact energy and the second end of the drill steel is releasably operatively interconnected with the disposable drill bit, the drill steel being adapted to transmit rotational and impact energy to the disposable drill bit, and wherein the drilling apparatus is characterized in that a portion of the drill steel proximate the second end thereof is adapted to be received within a standard friction bolt, the drill steel assembly is provided with a flange adapted to drive the friction bolt into a body requiring reinforcement, and the drill steel assembly is adapted to allow facile disconnection of the disposable drill bit therefrom, whilst the drilling apparatus is embedded in the body requiring reinforcement.

23 Claims, 7 Drawing Sheets

DRILLING APPARATUS AND METHOD FOR SINGLE PASS BOLTING

FIELD OF THE INVENTION

The present invention relates to a drilling apparatus and method for single pass bolting. More particularly, the present invention relates to a drilling apparatus and method for single pass rock bolting for reinforcement and stabilisation of excavations.

BACKGROUND ART

The installation of rock bolts to reinforce excavations is generally currently carried out in two distinct steps. A hole is drilled and the drill steel and bit extracted before the bolt is inserted into the hole and tightened or grouted. Single pass rock bolting involves carrying out these two steps simultaneously, with the task of removing the steel to insert the bolt being eliminated. The advantages of single pass bolting include minimising the time required for bolt installation, improving safety for drilling equipment operators and enhancing prospects for full automation of the process. A further advantage is improved quality and precision of rock bolt installation. The diameter of the hole is critical for rock bolt performance. Presently, differences in the properties of the ground drilled and the use of pre-used bits contribute to poor precision, and reduced -rock bolt performance. Single pass bolting enables an appropriate bit size to be selected for the ground drilled, and thus enables increased precision and improved rock bolt performance.

Prior attempts at single pass bolting have generally been targeted at innovative rock bolts, which also act as the drill steel, having a drill bit provided about an end thereof. Such apparatus are generally used via a rotational drilling method and are generally unsuitable for hard ground conditions. Existing hard ground percussive rock bolts which do not reuse the drill steel suffer from cost problems due to the requirement for water and/or air flushing through the bolt/steel, and the diameter and grade of drilling steel required for drilling through hard rock.

Drill bits adapted to be extracted through a casing are complex and accordingly expensive. Cost competitiveness of drilling speed versus bit cost are complicated in prior single pass rock bolts due to the use of specialised rock bolts and the exclusive use of either complex retractable bits, or expensive disposable bits.

The drilling apparatus and method of the present invention have as one object thereof to substantially overcome the abovementioned problems associated with the prior art, or at least provide an alternative thereto.

Throughout the specification, unless the context requires otherwise, the word "comprise", or variations such as "comprises" or "comprising", will be understood to imply the inclusion of a stated integer or group of integers but not the exclusions of any other integer or group of integers.

DISCOSURE OF THE INVENTION

In accordance with the present invention there is provided a drilling apparatus for single pass bolting, the drilling apparatus comprising a drill steel assembly and a disposable drill bit, wherein the drill steel assembly comprises at least a drill steel having first and second ends, the first end of the drill steel being adapted to releasably operatively engage a means for imparting rotational and impact energy and the second end of the drill steel is releasably operatively interconnected with the disposable drill bit, the drill steel being adapted to transmit rotational and impact energy to the disposable drill bit, and wherein the drilling apparatus is characterised in that a portion of the drill steel proximate the second end thereof is adapted to be received within a standard friction bolt, the drill steel assembly is provided with drive means adapted to drive the friction bolt into a body requiring reinforcement, and the drill steel assembly is adapted to allow facile disconnection of the disposable drill bit therefrom, whilst the drilling apparatus is embedded in the body requiring reinforcement.

Preferably, the drive means is provided in the form of a coupling member adapted to releasably receive the first end of the drill steel and the means for imparting rotational and impact energy, wherein the maximum diameter of the coupling member exceeds the diameter of the drill steel.

Preferably still, the coupling member comprises a first bore constructed to releasably receive the first end of the drill steel, and a second bore adapted to releasably receive the means for imparting rotational and impact energy, the head portion of the central bit housing and the aperture through the disposable drill bit are complementary polygonal cross section.

In a highly specific form of the invention, the first end of the drill steel is externally threaded, and the first bore of the coupling member is internally threaded.

In a highly specific form of the invention, the second bore is entemally threaded to match the externally threaded shank adapters of known drill jumbos.

In an alternate form of the invention, the drive means is provided in the form of a flange of diameter exceeding that of the friction bolt. The flange may be integrally provided with the drill steel.

Preferably, the disposable drill bit is of a diameter suitable for installation of the friction bolt in the body to be reinforced.

The drilling apparatus of the present invention may optionally further comprise rotation minimisation means by which rotational energy transmitted from the drill steel to the friction bolt is minimised. In one form of the invention, the rotation minimisation means is provided in the form a washer assembly, wherein at least one lubricated washer is rotatably provided about the drill steel, interposed between the flange of the drill steel and the friction bolt. In a highly preferred form of the invention, the washer assembly comprises two lubricated washers interposed between the flange of the drill steel and the friction bolt.

Preferably, a bore is provided through the drill steel assembly, the bore being adapted to convey water and/or air for flushing drilling debris.

Advantageously from an economic perspective, the disposable drill bit is provided in the form of a single use drill bit, of longevity approximately matched to the depth required for the friction bolt.

In one form of the invention, the disposable drill bit comprises an upper surface studded with teeth in a conventional arrangement, and a lower surface in which is provided a recess, the recess being adapted to directly receive the second end of the drill steel. Preferably, the second end of the drill steel and the recess in the disposable drill bit are of complementary polygonal cross section. Preferably still, the second end of the drill steel and the recess are hexagonal in cross section.

In an alternate form of the invention, the drill steel assembly further comprises a central bit housing adapted to releasably receive the second end of the drill steel and dimensioned to allow the friction bolt to pass thereover, and the disposable drill bit is of substantially annular configuration having an aperture through the centre thereof, wherein the central bit housing is at least partially releasably received through the aperture in the disposable drill bit and is adapted to transmit rotational and impact energy thereto.

Preferably, the central bit housing in turn comprises a head portion, atop which are provided a plurality of teeth, the head portion being adapted to be releasably received through the aperture in the disposable drill bit.

Preferably, the head portion of the central bit housing and the aperture through the disposable drill bit are of complementary polygonal cross section. Preferably still, the head portion of the central housing and the aperture through the disposable drill bit are hexagonal in cross section.

The second end of the drill steel may be of a conventional configuration. In one form of the invention, the second end of the drill steel is threaded, and a complementary threaded recess is provided in the central bit housing.

Preferably, the teeth provided on the head portion of the central bit housing are of a conventional, multiple use type.

In accordance with the present invention there is further provided a drilling apparatus and friction bolt combination, wherein the drilling apparatus comprises a drill steel assembly and a disposable drill bit, the drill steel assembly comprises at least a drill steel having first and second ends, the first end of the drill steel being adapted to releasably operatively engage a means for imparting rotational and impact energy, and the second end of the drill steel is releasably operatively interconnected with the disposable drill bit, the drill steel being adapted to transmit rotational and impact energy to the disposable drill bit, and wherein the drilling apparatus and friction bolt combination is characterized in that a portion of the drill steel proximate the second end thereof is received through the friction bolt, the drill steel assembly is provided with drive means adapted to drive the friction bolt into a body requiring reinforcement, and the drill steel assembly is adapted to allow facile disconnection of the disposable drill bit therefrom, whilst the drilling apparatus is embedded in the body requiring reinforceient.

Preferably, the drive means is provided in the form of a coupling member adapted to releasably receive the first end of the drill steel and the means for imparting rotational and impact energy, wherein the maximum diameter of the coupling member exceeds the diameter of the drill steel.

Preferably still, the coupling member comprises a first bore adapted to releasably receive the first end of the drill steel, and a second bore adapted to releasably receive the means for imparting rotational and impact energy.

In a highly specific form of the invention, the first end of the drill steel is externally threaded, and the first bore of the coupling member is internally threaded.

In a highly specific form of the invention, the second bore is internally threaded to match the externally threaded shank adapters of known drill jumbos.

In an alternate form of the invention, the drive means is provided in the form of a flange of diameter exceeding that of the friction bolt. The flange may be integrally provided with the drill steel.

Preferably, the disposable drill bit is of a diameter suitable for installation of the friction bolt in the body to be reinforced.

The drilling apparatus of the present invention may optionally further comprise rotation minimisation means by which rotational energy transmitted from the drill steel to the friction bolt is minimised. In one form of the invention, the rotation minimisation means is provided in the form a washer assembly, wherein at least one lubricated washer is rotatably provided about the drill steel, interposed between the flange of the drill steel and the friction bolt. In a highly preferred form of the invention, the washer assembly comprises two lubricated washers interposed between the flange of the drill steel and the friction bolt.

Preferably, a bore is provided through the drill steel assembly, the bore being adapted to convey water and/or air for flushing drilling debris.

Advantageously from an economic perspective, the disposable drill bit is provided in the form of a single use drill bit, of longevity approximately matched to the depth required for the friction bolt.

In one form of the invention, the disposable drill bit directly engages the drill steel. The disposable drill bit may comprise an upper surface studded with teeth in a conventional arrangement, and a lower surface. In one form of the invention, a recess is provided in the lower surface of the disposable drill bit, the recess being adapted to directly receive the second end of the drill steel. Preferably, the second end of the drill steel and the recess in the disposable drill bit are of complementary polygonal cross section. Preferably still, the second end of the drill steel and the recess are hexagonal in cross section.

Alternately, a recess may be provided in the second end of the drill steel, said recess engaging a complementary projection in the lower surface of the disposable drill bit. Preferably, the recess and the projection are of complementary polygonal cross section. Preferably still, the recess and the projection are hexagonal in cross section.

In a further alternate form of the invention, the drill steel assembly further comprises a central bit housing adapted to releasably receive the second end of the drill steel and dimensioned to allow the friction bolt to pass thereover, and the disposable drill bit is of substantially annular configuration having an aperture through the centre thereof, wherein the central bit housing is at least partially releasably received through the aperture in the disposable drill bit and is adapted to transmit rotational and impact energy thereto.

Preferably, the central bit housing in turn comprises a head portion, atop which are provided a plurality of teeth, the head portion being adapted to be releasably received through the aperture in the disposable drill bit.

Preferably, the head portion of the central bit housing and the aperture through the disposable drill bit are of complementary polygonal cross section. Preferably still, the head portion of the central housing and the aperture through the disposable drill bit are hexagonal in cross section.

The second end of the drill steel may be of a conventional configuration. In one form of the invention, the second end of the drill steel is threaded, and a complementary threaded recess is provided in the central bit housing.

Preferably, the teeth provided on the head portion of the central bit housing are of a conventional, multiple use type.

In accordance with the present invention there is provided a method for installation of friction bolts into a body requiring reinforcement, the method comprising the steps of:

Simultaneously boring a hole of suitable diameter whilst driving a friction bolt using a drilling apparatus and friction bolt combination, wherein the drilling apparatus comprises a drill steel assembly and a disposable drill bit, the drill steel assembly comprises at least a drill steel having first and second ends, the first end of the drill steel being adapted to receive a means for imparting rotational and impact energy, and the second end of the drill steel is releasably operatively interconnected with the disposable drill bit, the drill steel being adapted to transmit rotational and impact energy to the disposable drill bit, and wherein the drilling apparatus and friction bolt combination is characterized in that a portion of the drill steel proximate the second end thereof is received within a central bore through the friction bolt, the drill steel is provided with drive means adapted to drive the friction bolt into a body requiring reinforcement, and the drill steel assembly is adapted to allow facile disconnection of the disposable drill bit therefrom, whilst the drilling apparatus is embedded in the body requiring reinforcement; and Retracting the drill steel assembly through the friction bolt, leaving the disposable drill bit in the hole, and the friction bolt in place.

BRIEF DESCRIPTION OF THE DRAWINGS

The present invention will now be described, by way of example only, with reference to three embodiments thereof and the accompanying drawings, in which.

BEST MODE(S) FOR CARRYING OUT THE INVENTION

Figure 1:
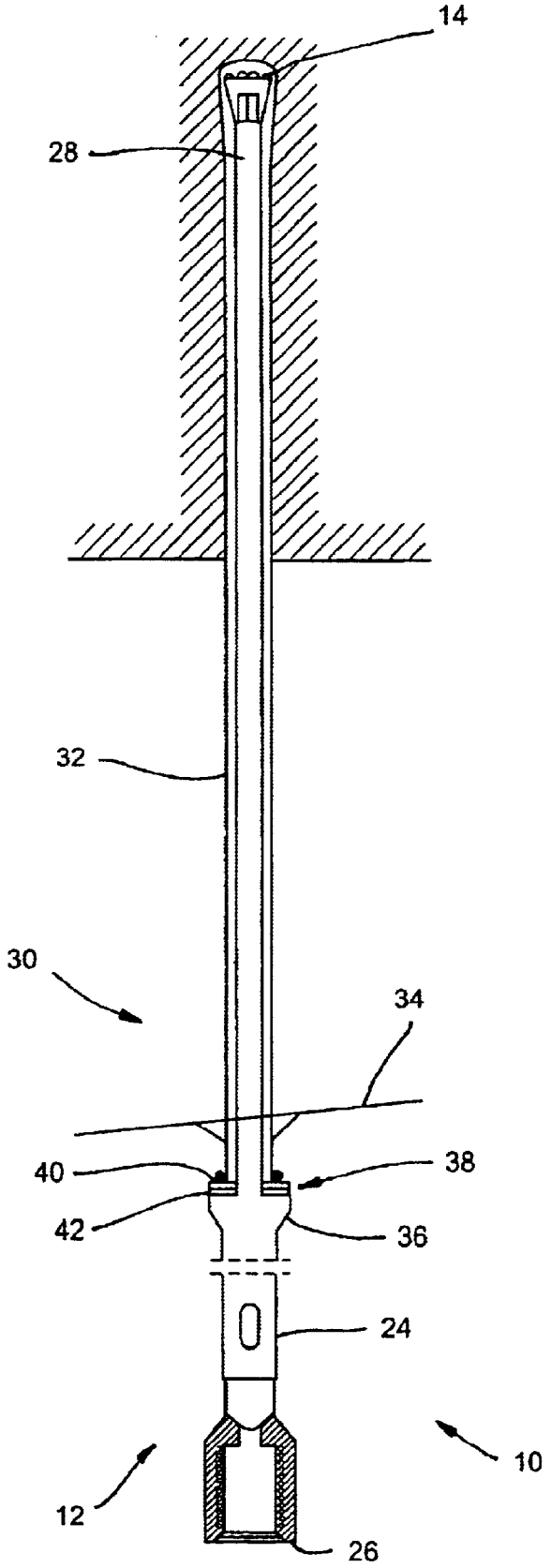
FIG. 1 is a cross sectional side view of a drilling apparatus in accordance with a first embodiment of the present invention, and a friction bolt in the process of being installed in a rock surface requiring reinforcement.
Figure 2:
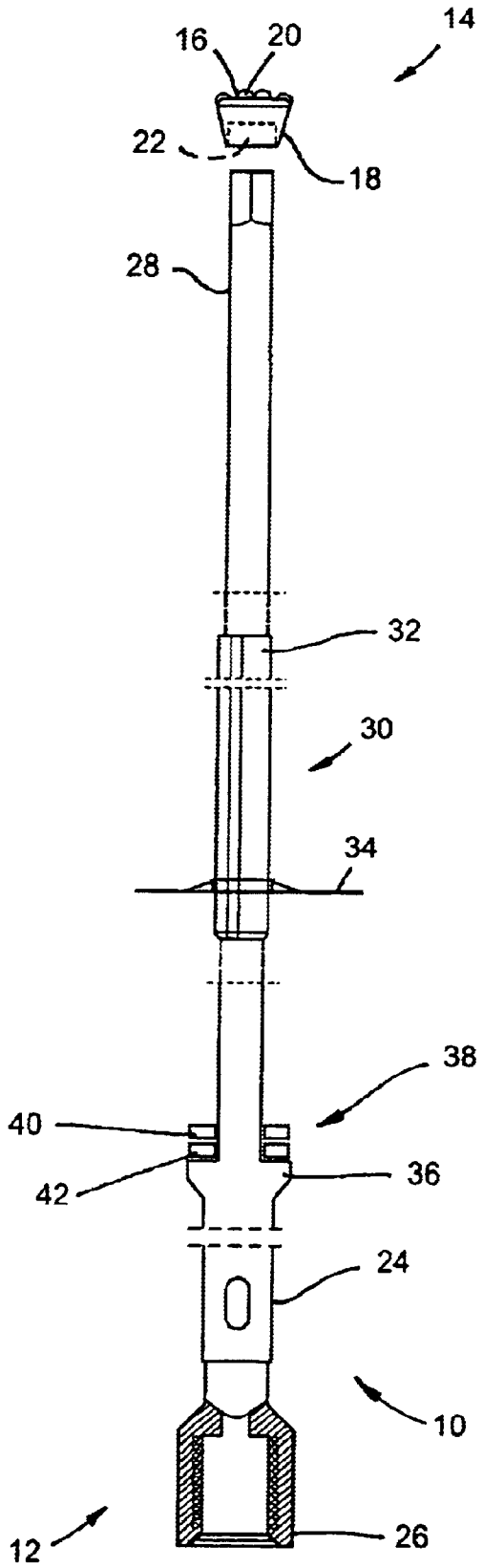
FIG. 2 is an exploded cross sectional side view of the drilling apparatus and friction bolt of FIG. 1, showing in particular a disposable drill bit engaging a second end of a drill steel.
Figure 3:
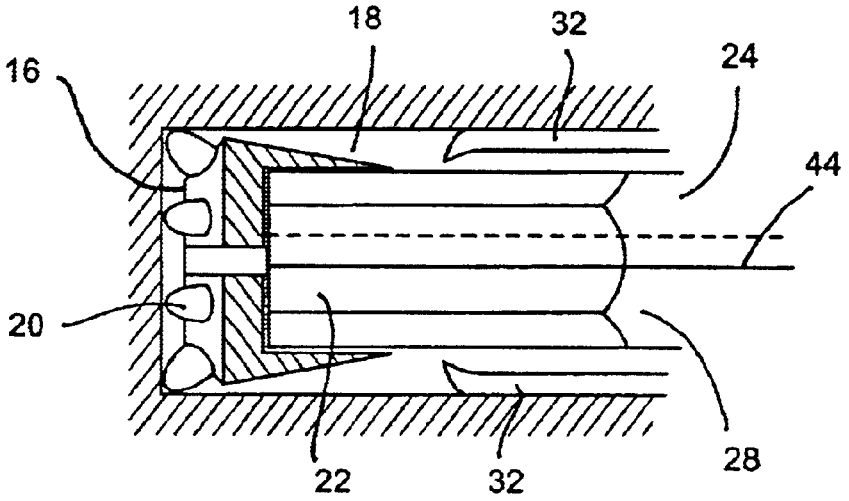
FIG. 3 is a detailed cross sectional side view of the disposable drill bit and second end of the drill steel of FIG. 2.
Figure 4:
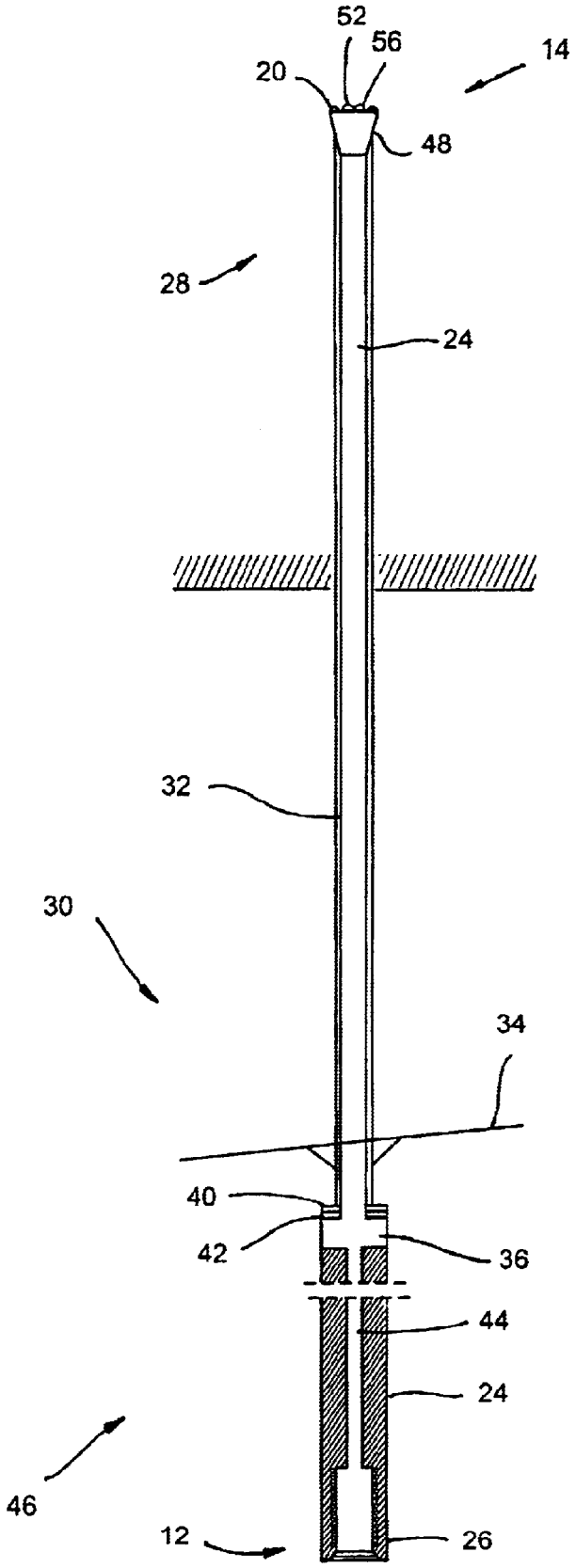
FIG. 4 is a cross sectional side view of a drilling apparatus in accordance with a second embodiment of the present invention, and a friction bolt in the process of being installed in a rock surface requiring reinforcement.
Figure 5:
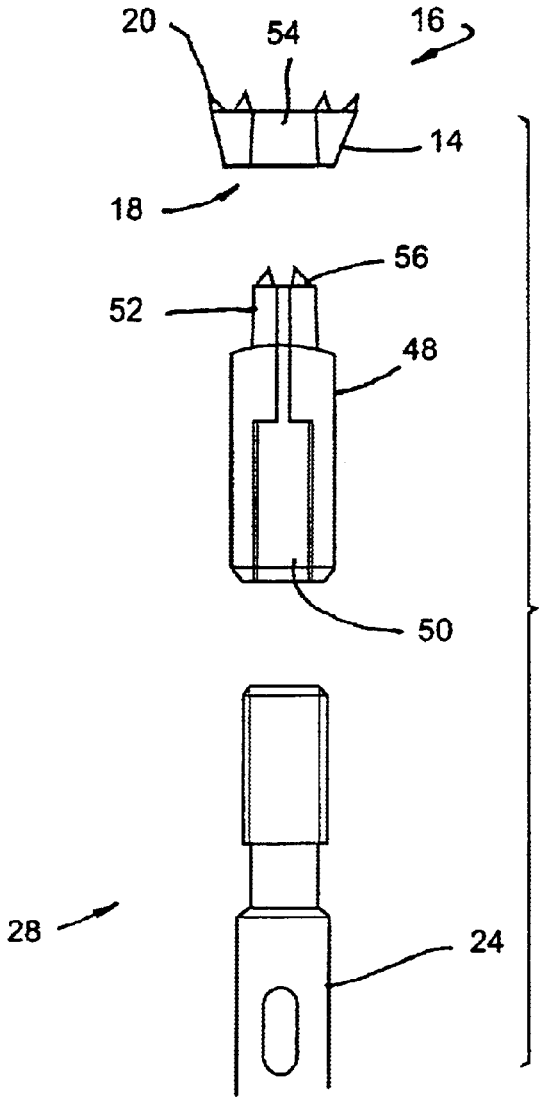
FIG. 5 is an exploded cross sectional side view of a drill steel, a central bit housing and an annular disposable drill bit of the drilling apparatus of FIG. 4.
Figure 6:
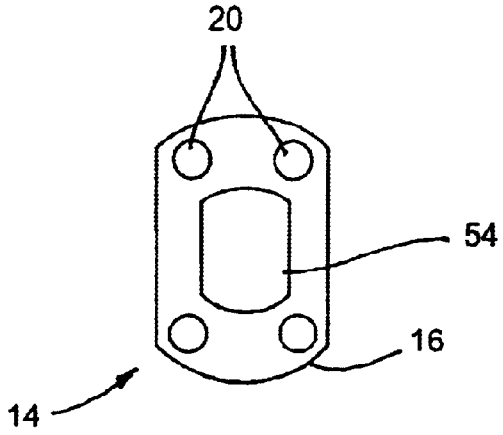
FIG. 6 is a plan view of the annular disposable drill bit of FIG. 5.
Figure 7:
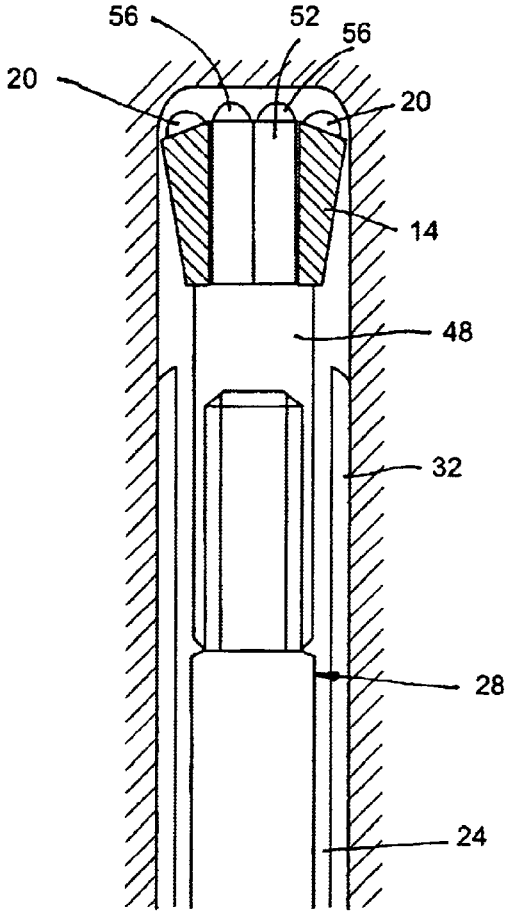
FIG. 7 is a partial cross sectional side view of the drilling apparatus of FIG. 4 showing the engagement of the drill steel with the central bit housing, and the engagement of the central bit housing with the disposable drill bit.

In FIGS. 1 to 3 there is shown a drilling apparatus 10 for single pass bolting, the drilling apparatus 10 comprising a drill steel assembly 12 and a disposable drill bit 14.

The disposable drill bit 14 comprises upper and lower surfaces 16 and 18. Provided about the upper surface 16 is a plurality of drill teeth 20, as can best be seen in FIGS. 2 and 3. Provided in the lower surface 18 is a recess 22 of hexagonal cross section.

The drill steel assembly 12 in turn comprises a drill steel 24, having first and second ends 26 and 28. The first end 26 of the drill steel 24 is adapted to receive a means for imparting rotational and impact energy (not shown), whilst the second end 28 thereof is of hexagonal cross section and is adapted to be partially and releasably received within the recess 22 of the disposable drill bit 14.

The drilling apparatus 10 is shown in conjunction with a standard SPLIT-SET type friction bolt assembly 30, in turn comprising a substantially tubular bolt portion 32, pivotally provided about which is a reinforcing plate 34.

Provided integrally with and about the first end 26 of the drill steel 24 is a drive means in the form of a flange 36. The flange 36 is of a diameter exceeding that of the bolt portion 32 of the friction bolt assembly 30 and the-friction bolt assembly 30 is provided about the drill steel 24, such that the reinforcing plate 34 is proximate the flange 36, as can best be seen in FIG. 1.

Interposed between the reinforcing plate 34 and the flange 36 and provided about the drill steel 24 is a rotation minimisation means, in the form of a washer assembly 38, comprising first and second washers 40 and 42, as can best be seen in FIG. 2. Lubricant (not shown) is provided between the first washer 40 and the reinforcing plate 34 of the friction bolt assembly 30, between the first and second washers 40 and 42, and between the second washer 42 and the flange 36 of the drill steel 24.

The disposable drill bit 14 is of a diameter exceeding the inside diameter of the bolt portion 32 of the friction bolt assembly 30, and suitable for installation thereof. Further, the disposable drill bit 14 is of the single-use type, with longevity approximating that required to drill a single hole of length approximating that of the bolt portion 32 of the friction bolt assembly 30.

A bore 44 is provided through the drill steel assembly 12 and the disposable drill bit 14, as can best be seen in FIG. 3, the bore 44 being adapted to convey water and/or air for flushing drilling debris.

Typically, the drill steel 24 is mounted on a means for imparting rotational and impact energy (not shown), such as a drilling jumbo, by way of the first end 26 of the drill steel 24. A source of flushing water and air is applied to the bore 44.

In preparation for drilling, a suitable friction bolt assembly 30 is placed over the drilling apparatus 10, such that the drill steel 24 passes through the bolt portion 32 of the friction bolt assembly 30, abutting the washer assembly 38. The disposable drill bit 14 is then placed on the second end 28 of the drill steel 24.

The user then positions the disposable drill bit 14 at a surface of body to be reinforced before imparting rotational and impact energy thereto by way of the engagement of the hexagonal second end 28 of the drill steel 24 with the recess 22 in the lower surface 18 of the disposable drill bit 14. As the drill bit 14 excavates a suitable bore, the flange 36 applies pressure to the friction bolt assembly 30, thereby driving such into the bore. Transmission of rotational motion from the drill steel 24 to the friction bolt assembly 30 is minimised by the washer assembly 38. Throughout the process, debris is removed by the action of flushing water and air conveyed through the bore 44.

When a bore of suitable depth has been reached, and the friction bolt assembly 30 driven to the requisite depth, the drill steel assembly 12 is withdrawn through the hollow bolt portion 32 of the friction bolt assembly, 30. The disposable drill bit 14 is readily detached from the second end 28 of the drill steel 24 by this action, and remains in situ. Thus, drilling and reinforcement bolting are performed in a single process.

In FIGS. 4 to 7 there is shown a drilling apparatus 46 in accordance with a second embodiment of the present invention. The drilling apparatus 46 is substantially similar to the drilling apparatus 10, and like numerals are used to denote like parts. However, in addition to the drill steel 24, the drill steel assembly 12 further comprises a central bit housing 48. Further, the second end 28 of the drill steel 24 is of a conventional, threaded configuration, as can best be seen in FIG. 5.

The central bit housing 48 is dimensioned to be telescopingly received within the bolt portion 32 of the friction bolt assembly 30, and comprises an internally threaded recess 50, adapted to receive the second end 28 of the drill steel 24, and a head portion 52.

The disposable drill bit. 14 is of a substantially annular configuration, with an aperture 54 of substantially hexagonal cross section being provided therethrough. The head portion 52 of the central bit housing 48 is of a complementary hexagonal cross section, and is adapted to be received through the aperture 54, thereby releasably engaging the disposable drill bit 14, as can best be seen in FIGS. 6 and 7. Teeth 56 are provided atop the head portion 52 which, unlike the teeth 20 of the disposable drill bit 14, are of a more durable, multiple use type.

In use, the drilling apparatus 46 is substantially identical to the drilling apparatus 10. However, rotational and impact energy are not transmitted directly from the drill steel 24 to the disposable drill bit 14. Rather, rotational and impact energy are transmitted from the drill steel 24 to the central bit housing 48 by way of engagement of such with the second end 28 of the drill steel 24. The head portion 52 of the central bit housing 48 in turn transmits rotational and impact energy to the disposable drill bit 14.

Further, when a bore of suitable depth has been reached, and the friction bolt assembly 30 driven to the requisite depth the drill steel assembly 12, including the central bit housing 48, is withdrawn through the hollow bolt portion 32 of the friction bolt assembly 30. The disposable drill bit 14 is readily detached from the head portion 52 of the central bit housing 48 by this action, and remains in situ.

Figure 8:
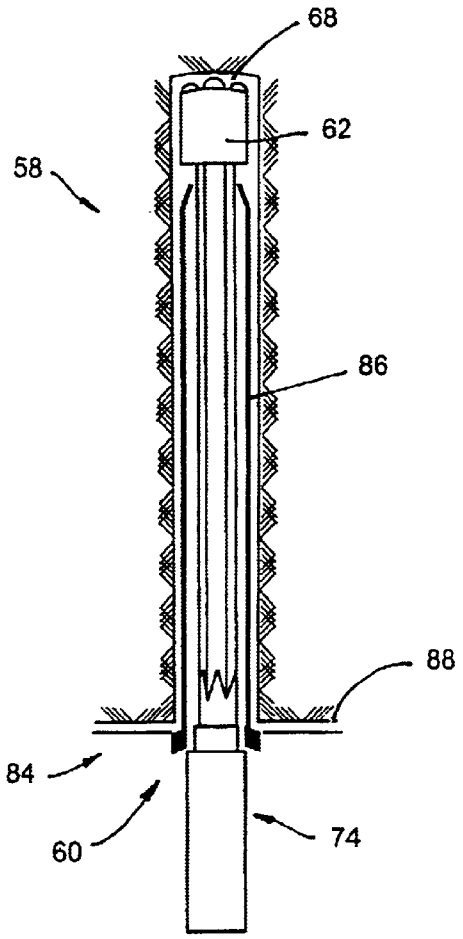
FIG. 8 is a cross sectional side view of a drilling apparatus in accordance with a third embodiment of the present invention, and a friction bolt in the process of being installed in a rock surface requiring reinforcement.
Figure 9:
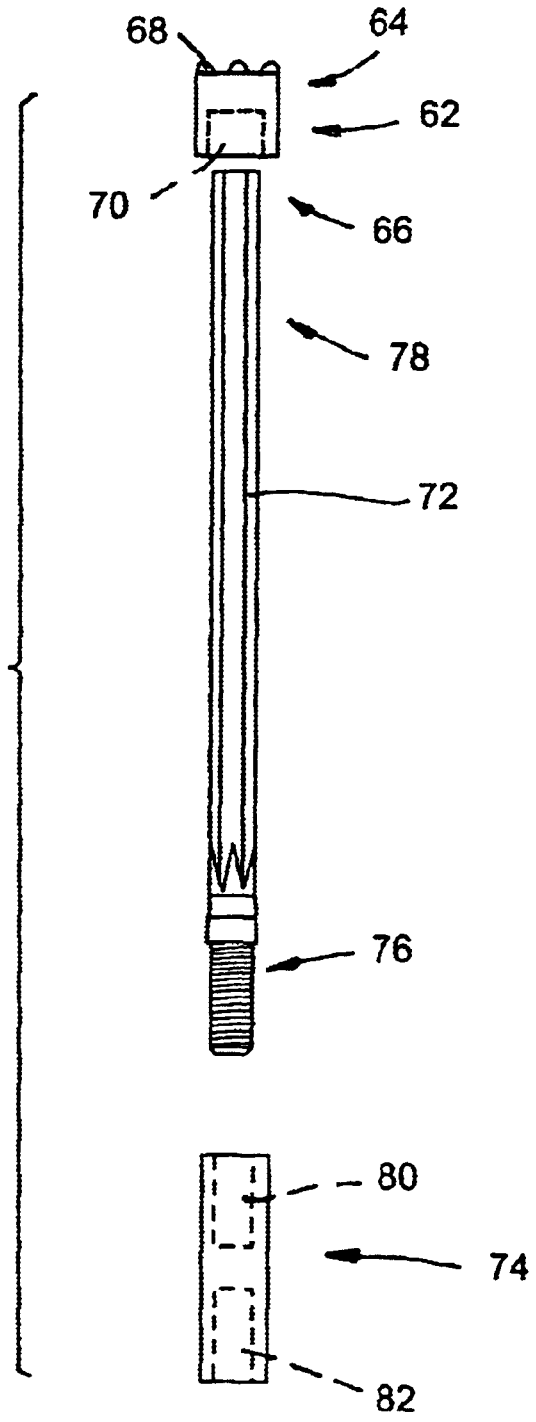
FIG. 9 is an exploded cross sectional side view of the drilling apparatus and friction bolt of FIG. 8, showing in particular a disposable drill bit engaging a second end of a drill steel.

In FIGS. 8 and 9 there is shown a drilling apparatus 58 for single pass bolting in accordance with a third embodiment of the present invention. The drilling apparatus 58 comprises a drill steel assembly 60 and a disposable drill bit 62.

The disposable drill bit 62 comprises upper and lower surfaces 64 and 66. Provided about the upper surface 64 is a plurality of drill teeth 68. Provided in the lower surface 66 is a recess 70 of hexagonal cross-section, as can best be seen in FIG. 9.

The drill steel assembly 60 comprises a drill steel 72 and a drive means in the form of a coupling member 74, of greater diameter than the drill steel 72. The drill steel 72 has first and second ends 76 and 78, whilst the coupling member 74 is provided with first and second opposed bores 80 and 82.

The first end 76 of the drill steel 72 is externally threaded is adapted to be received within the internally threaded first bore 80 of the coupling member 74. The second bore 82 of the coupling member 74 is also internally threaded and is adapted to receive a means for imparting rotational and impact energy, such as the shank adapter of a known drill jumbo (not shown).

The second end 78 of the drill steel 72 is of hexagonal cross section and is adapted to be partially and releasably received within the recess 70 of the disposable drill bit 62.

In FIG. 8, the drilling apparatus 58 is shown in conjunction with a standard SPLIT-SET type friction bolt assembly 84, in turn comprising a substantially tubular bolt portion 86, pivotally provided about which is a reinforcing plate 88.

The disposable drill bit 62 is of a diameter exceeding the inside diameter of the bolt portion 86 of the friction bolt assembly 84, and suitable for installation thereof. Further, the disposable drill bit 62 is of the single-use type, with longevity approximating that required to drill a single hole of length approximating that of the bolt portion 86 of the friction bolt assembly 84.

Typically, coupling member 74 is attached to a means for imparting rotational and impact energy such as a drilling jumbo (not shown), by way of the second bore 82 of the coupling member 74. The drill steel 72 is in turn attached to the coupling member 74 by way of engagement of the threaded first end 76 of the drill steel 72 with the first bore 80 of the coupling member 74.

In preparation for drilling, a suitable friction bolt assembly 84 is then placed over the drill steel 72, such that the drill steel 72 passes through the bolt portion 86 of the friction bolt assembly 84, abutting the coupling member 74. The disposable drill bit 62 is then placed on the second end 28 of the drill steel 24

A user (not shown) then positions the disposable drill bit 62 at a surface of body to be reinforced before imparting rotational and impact energy thereto by way of the engagement of the hexagonal second end 78 of the drill steel 72 with the recess 70 of the disposable drill bit 62. As the drill bit 62 excavates a suitable bore, the coupling member 74 applies pressure to the friction bolt assembly 84, thereby driving such into the bore.

When a bore of suitable depth has been reached, and the friction bolt assembly 84 driven to the requisite depth, the drill steel assembly 60 is withdrawn through the hollow bolt portion 86 of the friction bolt assembly 84. The disposable drill bit 62 is readily detached from the second end 78 of the drill steel 72 by this action, and remains in situ. Thus, drilling and reinforcement bolting are performed in a single process.

It is envisaged that the drilling apparatus 10, 46 or 58 and the friction bolt assembly 30 or 84 may be supplied in assembled form.

It is further envisaged that the drilling apparatus 10, 46 or 58 would be manufactured with drill steels 24 or 72 of a range of sizes to suit presently available friction bolt assemblies 30 or 84.

It is still further envisaged that the disposable drill bit 14 or 62 may be manufactured largely by a forging process, with only the upper surface 16 or 64 thereof being machined to create teeth 20 or 68, or accommodate inserted teeth 20 or 68. It is yet further envisaged that inserted teeth 20 or 68 may be formed of hardened steel or tungsten carbide, whilst integral teeth 20 or 68 formed by machining may be coated with a wear protective coating, such as TiN, or diamond.

The disposable drill bit 14 or 62 may also be produced by processes involving casting, machining or sintering.

Modifications and variations such as would be apparent to the skilled addressee are considered to fall within the scope of this application.

What is claimed is:

1. A drilling apparatus for single pass bolting, the drilling apparatus comprising a drill steel assembly and a disposable drill bit, wherein the drill steel assembly comprises at least a drill steel having first and second ends, the first end of the drill steel being constructed to releasably operatively engage a means for imparting rotational and impact energy and the second end of the drill steel is releasably operatively interconnected with the disposable drill bit, the drill steel being constructed to transmit rotational and impact energy to the disposable drill bit, and wherein the drilling apparatus is characterized in that a portion of the drill steel proximate the second end thereof is constructed to be received within a circumferential compression type friction bolt, the drill steel assembly is provided with drive means constructed to drive the friction bolt into a body requiring reinforcement, and the drill steel assembly is constructed to allow facile disconnection of the disposable drill bit therefrom and through the friction bolt, whilst the drilling apparatus is embedded in the body requiring reinforcement.

2. A drilling apparatus according to claim 1 characterized in that the drive means is provided in the form of a coupling member constructed to releasably receive the first end of the drill steel and the means for imparting rotational and impact energy, wherein the maximum diameter of the coupling member exceeds the diameter of the drill steel.

3. A drilling apparatus according to claim 2 characterized in that the coupling member comprises a first bore constructed to releasably receive the first end of the drill steel, and a second bore constructed to releasably receive the means for imparting rotational and impact energy.

4. A drilling apparatus according to claim 2 characterized in that the coupling member comprises a first bore constructed to releasably receive the first end of the drill steel, and a second bore constructed to releasably receive the means for imparting rotational and impact energy wherein, the first end of the drill steel is externally threaded, and the first bore of the coupling member is internally threaded.

5. A drilling apparatus according to claim 2 characterized in that the coupling member comprises a first bore constructed to releasably receive the first end of the drill steel, and a second bore constructed to releasably receive the means for imparting rotational and impact energy, the second bore being internally threaded to match the externally threaded shank adapters of known drill jumbos.

6. A drilling apparatus according to claim 1 characterized in that the drive means is provided in the form of a flange of diameter exceeding that of the friction bolt.

7. A drilling apparatus according to claim 6 characterized in that the flange is integrally provided with the drill steel.

8. A drilling apparatus according to claim 1 characterized in that the drilling apparatus further comprises a rotation minimisation means by which rotational energy transmitted from the drill steel to the friction bolt is minimised.

9. A drilling apparatus according to claim 8 characterized in that the rotation minimisation means is provided in the form a washer assembly, wherein at least one lubricated washer is rotatably provided about the drill steel, interposed between the flange of the drill steel and the friction bolt.

10. A drilling apparatus according to claim 8 characterized in that the rotation minimisation means is provided in the form a washer assembly, wherein at least one lubricated washer is rotatably provided about the drill steel, interposed between the flange of the drill steel and the friction bolt the washer assembly comprising two lubricated washers interposed between the flange of the drill steel and the friction bolt.

11. A drilling apparatus according to claim 1 characterized in that a bore is provided through the drill steel assembly, the bore being constructed to convey water and/or flushing drilling debris.

12. A drilling apparatus according to claim 1 characterized in that the disposable drill bit is provided in the form of a single use drill bit, of longevity approximately matched to the drilling depth required for the installation of a friction bolt.

13. A drilling apparatus according to claim 1 characterized in that the disposable drill bit comprises an upper surface studded with teeth in a conventional arrangement, and a lower surface in which is provided a recess, the recess being constructed to directly receive the second end of the drill steel.

14. A drilling apparatus according to claim 13 characterized in that the second end of the drill steel and the recess in the disposable drill bit are of complementary polygonal cross section.

15. A drilling apparatus according to claim 13 characterized in that the second end of the drill steel and the recess are hexagonal in cross section.

16. A drilling apparatus according to claim 1 characterized in that the drill steel assembly further comprises a central bit housing constructed to releasably receive the second end of the drill steel and dimensioned to allow the friction bolt to pass thereover, and the disposable drill bit is of substantially annular configuration having an aperture through the centre thereof, wherein the central bit housing is at least partially releasably received through the aperture in the disposable drill bit and is constructed to transmit rotational and impact energy thereto.

17. A drilling apparatus according to claim 16 characterized in that the central bit housing in turn comprises a head portion, atop which are provided a plurality of teeth, the head portion being constructed to be releasably received through the aperture in the disposable drill bit.

18. A drilling apparatus according to claim 16 characterized in that the central bit housing in turn comprises a head portion, atop which are provided a plurality of teeth, the head portion being constructed to be releasably received through the aperture in the disposable drill bit, the head portion of the central bit housing and the aperture through the disposable drill bit being of complementary polygonal cross section.

19. A drilling apparatus according to claim 16 characterized in that the central bit housing in turn comprises a head portion, atop which are provided a plurality of teeth, the head portion being constructed to be releasably received through the aperture in the disposable drill bit, the head portion of the central housing and the aperture through the disposable drill bit being of complementary hexagonal cross section.

20. A drilling apparatus according to claim 16 characterized in that the second end of the drill steel is threaded, and a complementary threaded recess is provided in the central bit housing.

21. A drilling apparatus according to claim 16 characterized in that the teeth provided on the head portion of the central bit housing are of a conventional, multiple use type.

22. A drilling apparatus and circumferential compression type friction bolt combination, wherein the drilling apparatus comprises a drill steel assembly and a disposable drill bit, the drill steel assembly comprises at least a drill steel, having first and second ends, the first end of the drill steel being constructed to releasably operatively engage a means for imparting rotational and impact energy, and the second end of the drill steel is releasably operatively interconnected with the disposable drill bit, the drill steel being constructed to transmit rotational and impact energy to the disposable drill bit, and wherein the drilling apparatus and friction bolt combination is characterized in that a portion of the drill steel proximate the second end thereof is received through the friction bolt, the drill steel assembly is provided with drive means constructed to drive the friction bolt into a body requiring reinforcement, and the drill steel assembly is constructed allow facile disconnection of the disposable drill bit therefrom, whilst the drilling apparatus is embedded in the body requiring reinforcement.

23. A method for installation of friction bolts into a body requiring reinforcement, the method comprising the steps of:

simultaneously boring a hole of suitable diameter whilst driving a friction bolt using a drilling apparatus and friction bolt combination, wherein the drilling apparatus comprises a drill steel assembly and a disposable drill bit, the drill steel assembly comprises at least a drill steel, having first and second ends, such that the first end of the drill steel is constructed to receive a means for imparting rotational and impact energy, and the second end of the drill steel is releasably operatively interconnected with the disposable drill bit, the drill steel being constructed to transmit rotational and impact energy to the disposable drill bit, and wherein the drilling apparatus and friction bolt combination is characterized in that a portion of the drill steel proximate the second end thereof is received within a central bore through the friction bolt into a body requiring reinforcement, and the drill steel assembly is constructed to allow facile disconnection of the disposable drill bit therefrom, whilst the drilling apparatus is embedded in the body requiring reinforcement; and retracting the drill steel assembly through the friction bolt, leaving the disposable drill bit in the hole, and the friction bolt set in place.

* * * * *